US005465960A

United States Patent [19]

Bickerton et al.

[11] Patent Number: 5,465,960

[45] Date of Patent: Nov. 14, 1995

[54] BATON WITH EXTENSIBLE HANDLE AND FOLDABLE CROSSHANDLE

[75] Inventors: David J. Bickerton, Keynsham; David Wakefield, Great Barr, both of United Kingdom

[73] Assignee: Hiatt and Company Limited, United Kingdom

[21] Appl. No.: 315,527

[22] Filed: Sep. 30, 1994

[30] Foreign Application Priority Data

Oct. 1, 1993 [GB] United Kingdom ..... 9320320

[51] Int. Cl.[6] ..... F41B 15/02

[52] U.S. Cl. ..... 273/84 R; 135/75

[58] Field of Search ..... 273/84 R, 84 ES, 273/84 A; 135/72, 75, 66, 74, 76, 69; 42/71.01, 72

[56] References Cited

U.S. PATENT DOCUMENTS 5,085,433 2/1992 Parsons .

FOREIGN PATENT DOCUMENTS

04320051A1 6/1991 European Pat. Off. .

*Primary Examiner*—William M. Pierce

*Attorney, Agent, or Firm*—Kirschstein, et al.

[57] ABSTRACT

A baton, e.g. for use by police, has a shaft and a handle, the handle being movable relative to the shaft between a first position in which it is generally in line with the shaft and a second position in it extends transversely to the shaft. A further handle is extendible when the first handle has been moved to extend transversely, and the shaft of the baton also may be extendible. Thus the baton is convertible from a compact straight configuration to a side-handled configuration.

13 Claims, 7 Drawing Sheets

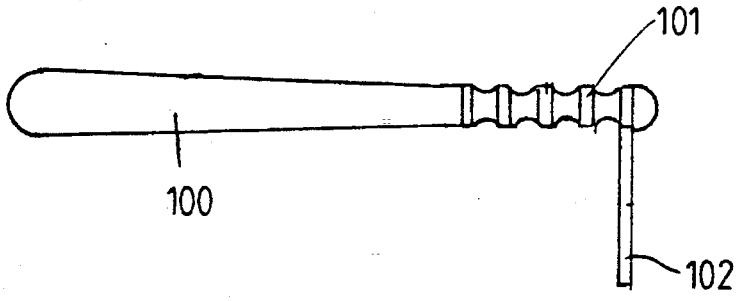
FIG 1
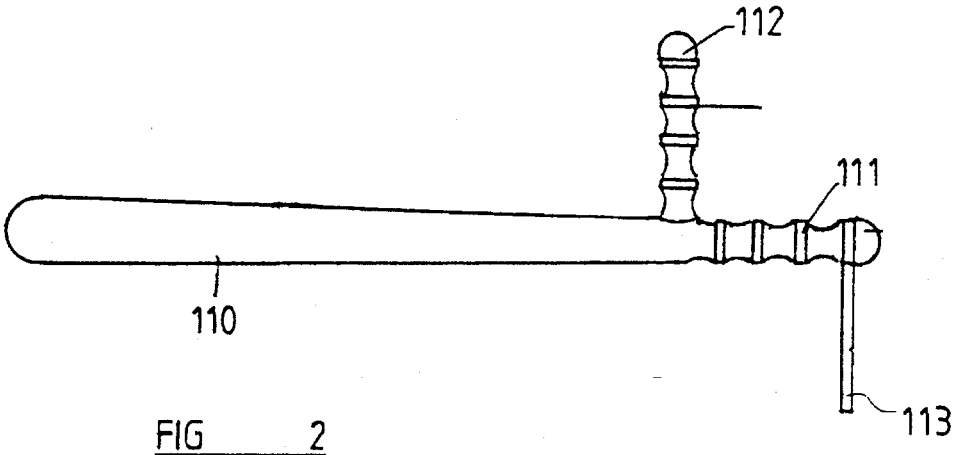
FIG 2
FIG 3a
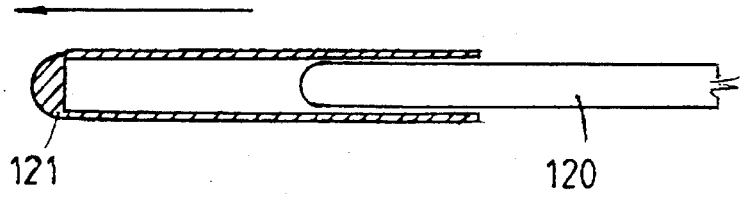
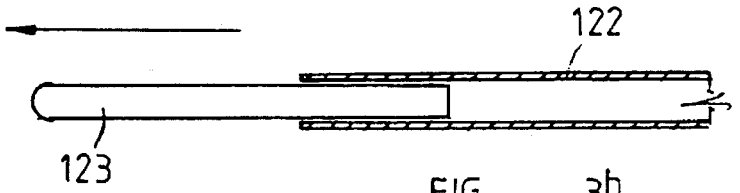
FIG 3b

BATON WITH EXTENSIBLE HANDLE AND FOLDABLE CROSSHANDLE

BACKGROUND OF THE INVENTION

This invention relates to a baton or truncheon (herein called a baton).

Batons are in common use by police forces and security services as offensive and defensive weapons. Until recent times batons have usually been made in a fixed length and configuration, with a range of lengths available to meet specific requirements of users. Telescopically extendable batons have also been proposed.

A type of baton is known which includes a side handle in addition to a handle generally in line with the main body or shaft of the baton. The side handle is fixed at right angles or thereabouts to the line of the main shaft and handle. Because of its origins and configuration, this type of baton is commonly referred to as the American side-handled baton.

For certain users, notably the British police forces, it is general practice for an officer to carry a baton concealed. This presents practical limitations on the type of baton which can be carried, in that the length of the baton is restricted. It is difficult to carry a side-handled baton, or indeed anything other than a short straight baton, concealed.

Accordingly it is the object of the present invention to provide a baton which overcomes or reduces such limitations.

SUMMARY OF THE INVENTION

According to the present invention, we provide a baton comprising a shaft and a handle, the handle being movable relative to the shaft between a first position in which it is generally in line with the shaft and a second position in which it extends transversely to the shaft.

Preferably there is a further handle in line with said shaft, the first said handle, when in its second position, extending transversely at a position in the vicinity of where the further handle extends from the shaft.

Preferably the first said handle is pivotable between its first and second positions.

When in its first position, the first handle may interfit with the shaft of the baton, or with the further handle. To this end, the first handle may include a recess extending lengthwise thereof, in which recess the shaft or further handle lies when the first handle is in its position generally in line with the shaft. This enables the further handle to be fixed relative to the shaft.

Alternatively, the further handle may be movable relative to the shaft in the direction lengthwise thereof, between an extended position which it can assume when the first handle is in its second position, and a retracted position which enables the first handle to assume its first position in line with the shaft and occupying the space which the further handle occupies when extended.

The shaft may comprise two or more portions movable lengthwise, e.g. telescopically, relative to one another so that the shaft is extendable and collapsible.

Preferably there is catch means for retaining at least one of the parts of the baton in at least one of the positions capable of being assumed thereby, as above referred to.

There may be biasing means for biasing at least one of the parts of the baton to one of the positions capable of being assumed thereby, as above referred to. Thus, the first said handle may be biased to its second position in which it extends transversely to the shaft of the baton. The further handle, if movable relative to the shaft, may be biased to its extended position. If the shaft of the baton is extendable lengthwise, it may be biased to its extended condition.

Such biasing means may comprise a spring or springs, or alternatively, for example, fluid pressure, e.g. gas pressure, means may be provided.

Alternatively, the parts may be movable in response to appropriate wielding of the baton by a user, so that the masses of the various parts cause the movement.

The baton may have a flexible strap for holding by a user, e.g. fitted to the or one of the handles thereof.

BRIEF DESCRIPTION OF THE DRAWINGS

These and other features of the invention will now be described by way of example with reference to the accompanying drawings, of which:

FIG. 1 illustrates a conventional straight baton;

FIG. 2 illustrates a conventional side-handled baton;

FIGS. 3(*a*) and (*b*) illustrate diagrammatically how a shaft of a baton may be extended;

DESCRIPTION OF THE PREFERRED EMBODIMENTS

Figure 4A:
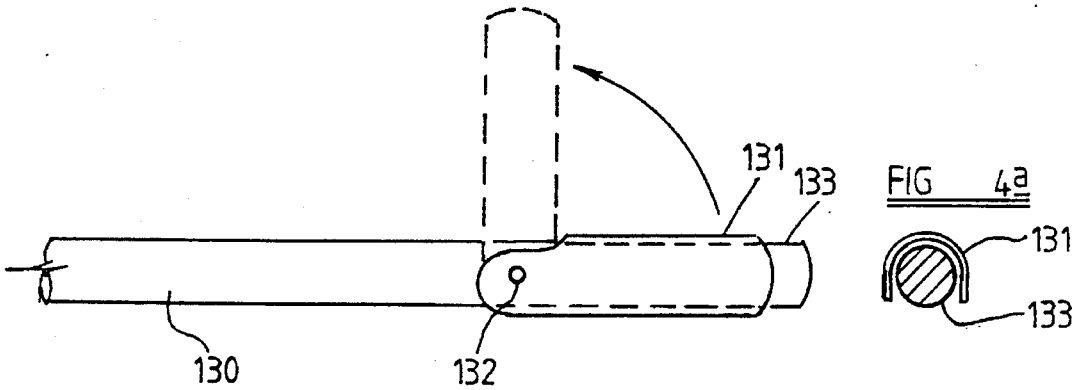
FIGS. 4(*a*) to 4(*d*) illustrate possible configurations of baton according to the invention.
Figure 4B:
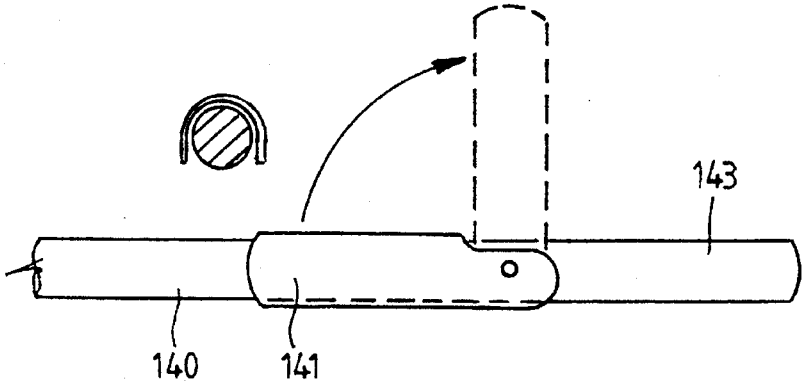
Figure 4C:
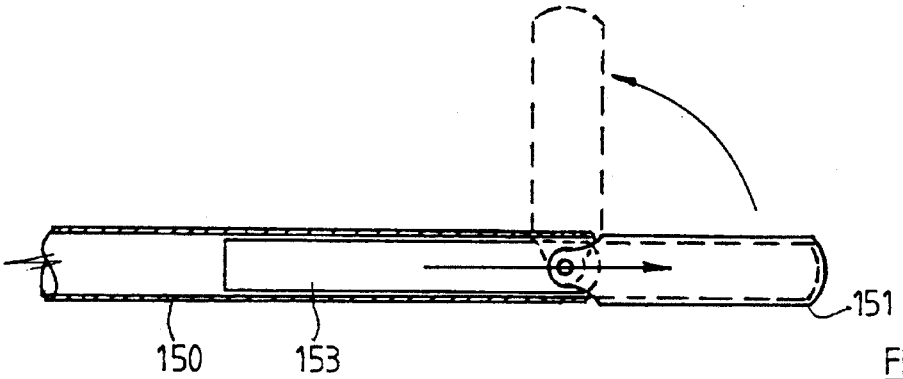
Figure 4D:
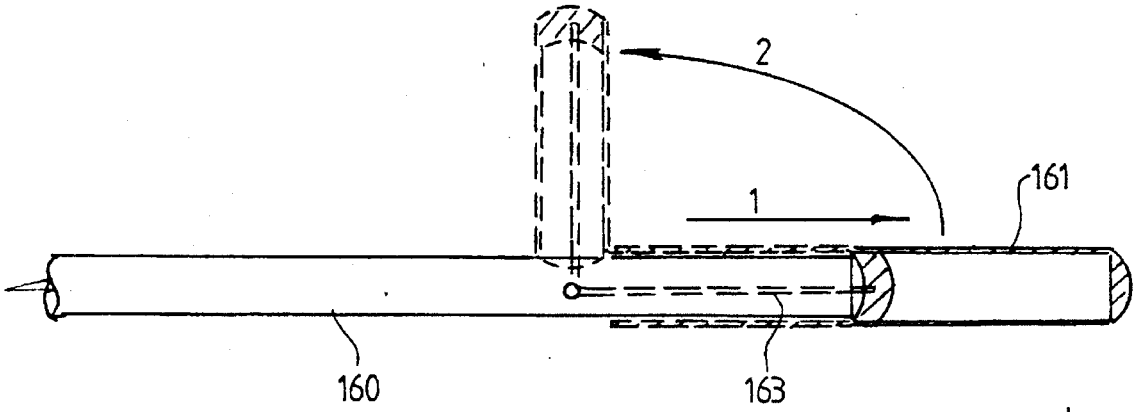

Referring firstly to FIG. 1 of the drawings, this illustrates a simple baton, usually known in Britain as a truncheon, of known type. It comprises a shaft 100 and a handle 101 in line with the shaft and shaped to provide for gripping by the hand. The shaft 100 is slightly tapered being of larger cross-section at its end remote from the handle, and the handle 101 is provided with a flexible strap 102 which may be worn around the wrist of a user.

FIG. 2 shows a side-handled baton of known type, comprising a shaft 110, a handle 111 in line with the shaft, and a side handle 112 extending transversely outwardly from the shaft and handle 111, in the vicinity of where such handle connects to the shaft. The side handle 112 is substantially perpendicular to the shaft and handle 111. There is also a wrist strap 113.

FIGS. 3(*a*) and 3(*b*) show how a shaft of a baton may be telescopically extendable. FIG. 3(*a*) shows a shaft portion 120 to which a handle or handles as FIG. 1 or 2 is fixed. A tubular shaft portion 121, into the interior of which the shaft portion 120 may be slid, is provided. In FIG. 3(*b*) there is a tubular shaft portion 122 on which a handle or handles may be provided, and a solid shaft portion 123 slidable into the interior of the shaft portion 122 and movable outwardly therefrom to bring the shaft of the baton to an extended configuration.

FIG. 4(*a*) shows, diagrammatically, a first embodiment of baton according to the invention. This baton comprises a shaft 130, a first handle 131 which is pivotable relative to the shaft about a transverse axis indicated at 132, and a further handle 133 which is fixed in line with the shaft 130. The handle 131, as shown in the inset to FIG. 4(*a*), is of U-shaped cross-section so as to afford a recess extending lengthwise of the handle 131, capable of receiving the handle 133. The handle 131 thus is pivotable between a first position, shown in full lines in FIG. 4(*a*), in which it is in line with the shaft and handle 133, and a second position, shown in broken lines, wherein it extends transversely to the shaft and handle 133. Preferably it extends at right angles to the shaft 130 and handle 133 in the latter position, and means is provided for retaining the handle 131 in such position so that it is rigid enabling the baton to be used as a conventional side-handled baton.

FIG. 4(*b*) shows a baton analogous to that of FIG. 4(*a*), with a shaft 140, handle 141, and further handle 143. In this case, however, the handle 141 is mounted relative to the shaft and handle 143 so that in a first position in line with the shaft and handle 143 it is the shaft which lies within the recess afforded by the handle 141.

FIG. 4(*c*) shows a baton with a shaft 150 which is of tubular configuration. A first handle 151 is pivotably secured to the shaft 150, and is movable relative thereto between the position in which it is shown in full lines in FIG. 4(*c*), in line with the shaft 150, and the position in which it is shown in broken lines wherein it extends outwardly from the shaft 150 generally at right angles thereto. A further handle 153 is telescopically slidable within the shaft 150, and when the first handle 151 is in its latter position the further handle 153 can be slid out from the shaft 150, to an extended position shown in broken lines wherein it can be grasped as a handle.

FIG. 4(*d*) shows a baton with a shaft 160 and a handle 161. The handle 161 is of tubular configuration and is connected to the shaft 160 for both sliding and swivelling relative thereto. In a first position of the handle 161, it is in line with the shaft 160 and receives in its interior a further handle 163 fixed to the shaft 160. The handle 161 can be slid axially away from the shaft 160, as indicated by arrow 1 on FIG. 4(*d*), until it is clear of the fixed handle 163, pivoted to an orientation at right angles to the shaft 160, and then slid axially to the position in which it is shown in broken lines in FIG. 4(*d*), to be usable as a side handle.

Figure 5:
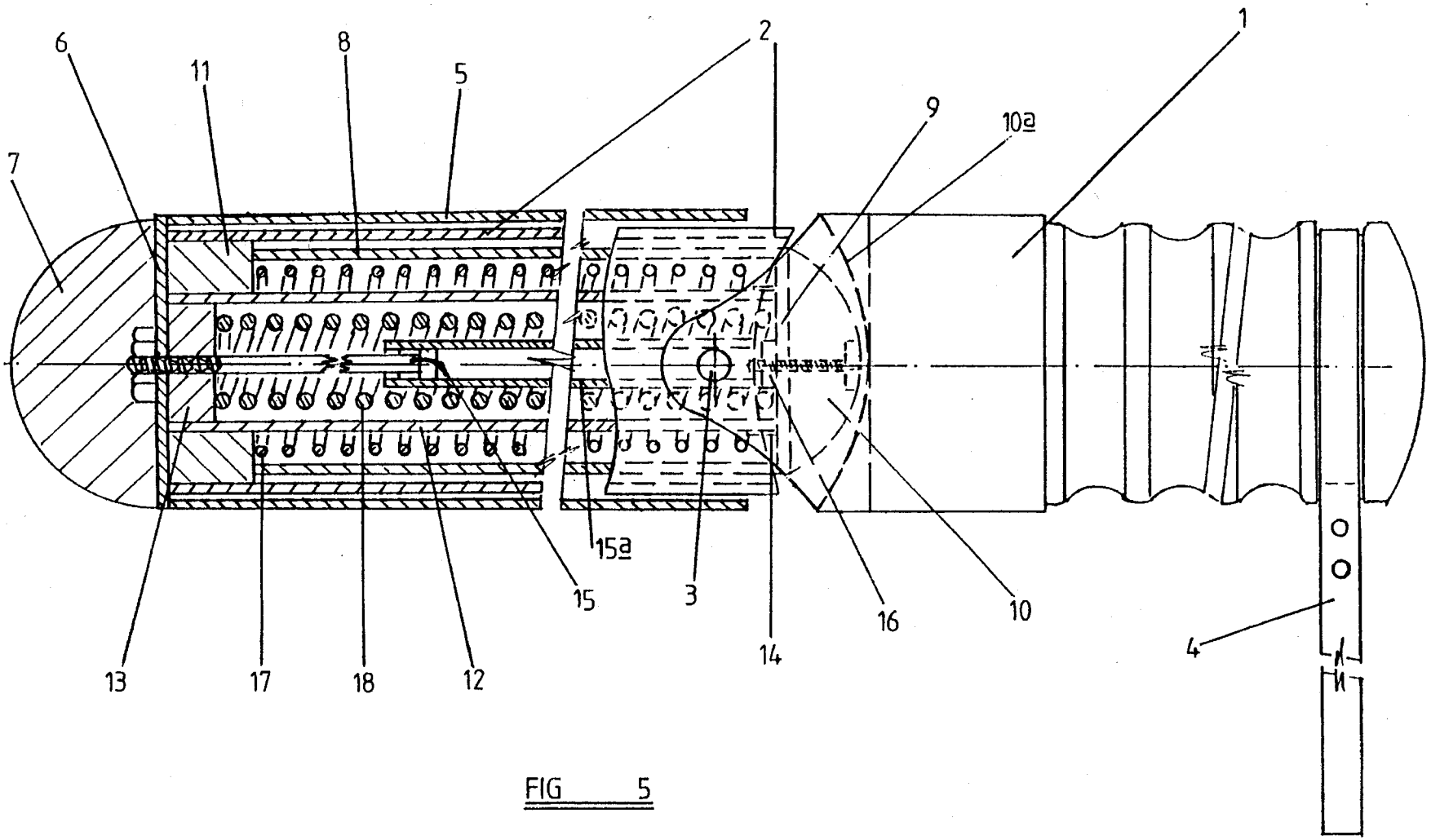
FIG. 5 is a diagrammatic elevation, partly in section, of an embodiment of baton according to the invention.
Figure 6:
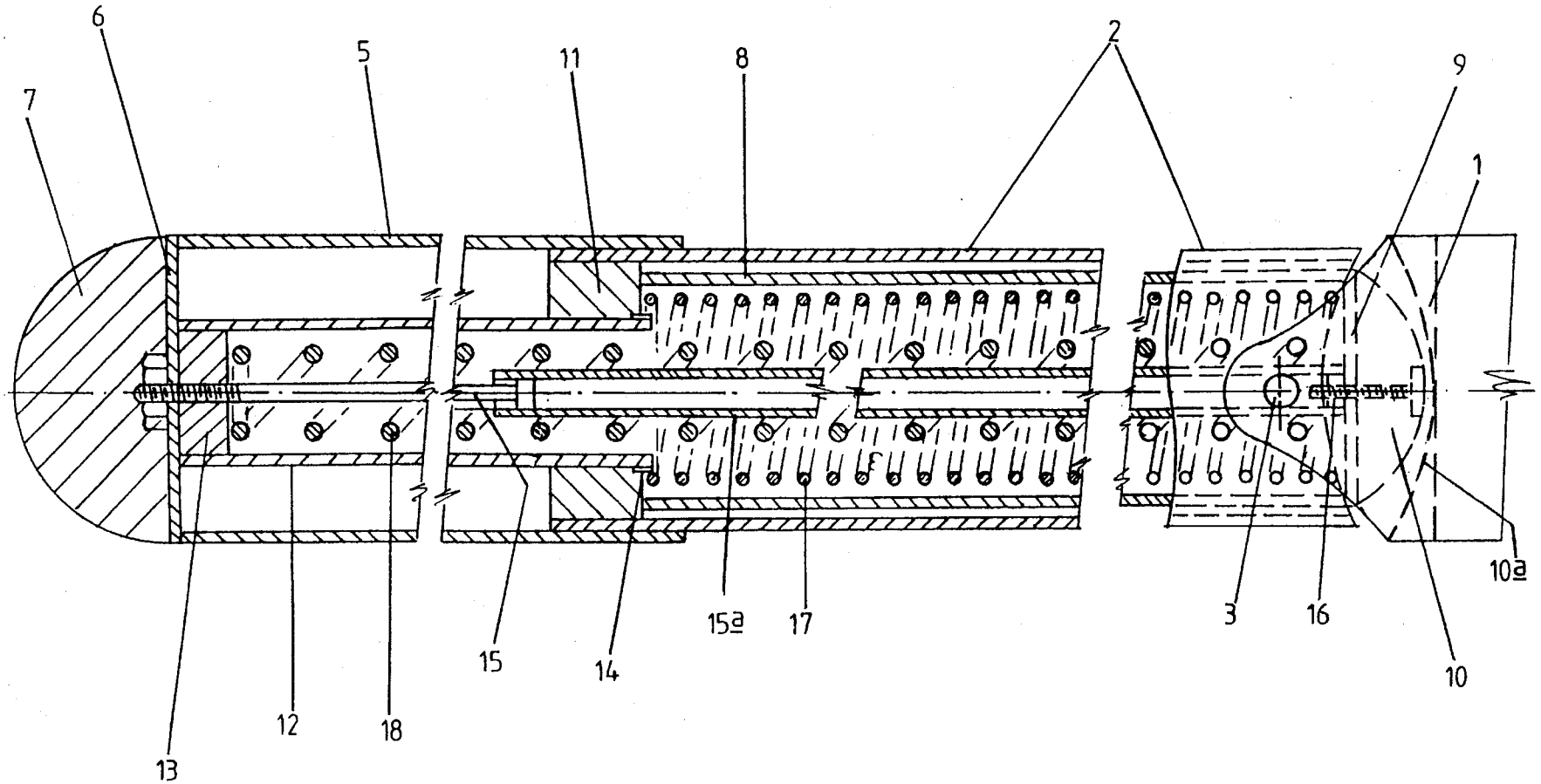
FIG. 6 is a view as FIG. 5 but with the baton partially extended.
Figure 7:
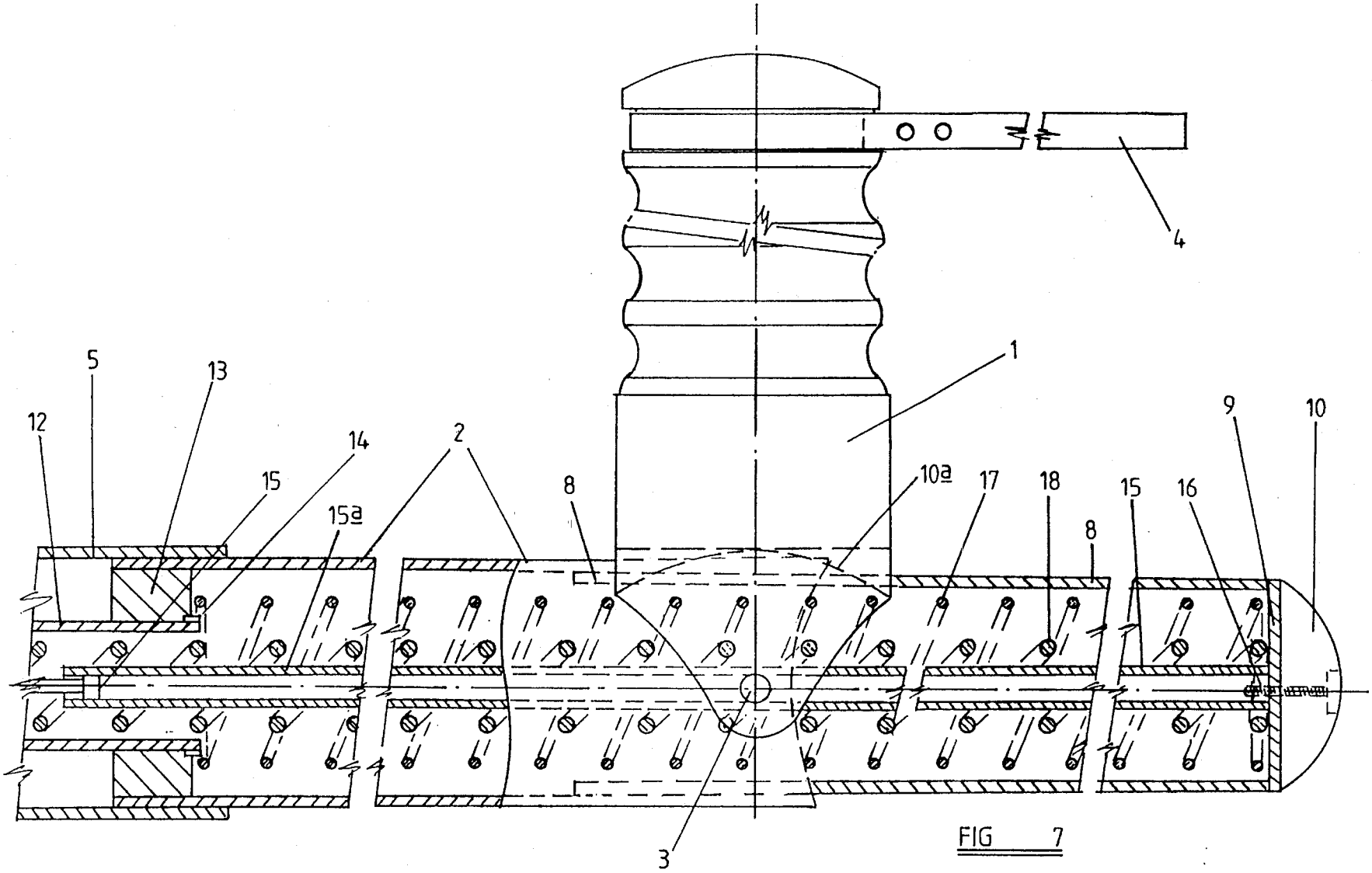
FIG. 7 is a view of the baton as FIGS. 5 and 6, but in a further extended configuration.

Referring now to FIGS. 5, 6 and 7 of the drawings, these show in more detail a baton according to the invention, which is operable in the manner of the baton shown diagrammatically in FIG. 4(*c*). The baton comprises a first handle 1 which is pivotally secured as indicated at 3 to a tubular shaft portion 2. The handle 1 has a handgrip portion and a wrist strap 4, and has respective portions which cooperate with diametrically opposed portions of the shaft portion 2 and are secured thereto by rivets, bolts or the like, to provide the pivotal connection as indicated at 3. In FIGS. 5 and 6 the handle 1 is shown in a position in which it is in line with the shaft of the baton, which comprises the shaft portion 2 and a further tubular shaft portion 5 which is of larger diameter than the portion 2 so as to be able to slide over the exterior of the latter with a close sliding fit. The shaft portion 5 is closed at one end by an end plate 6 to which is secured a hemispherical end cap 7.

A further handle 8 of tubular configuration has an outside diameter such that it is a close sliding fit within the interior of the tubular shaft portion 2. The further handle 8 is closed at one end by an end plate 9 to which is attached a part-spherical end cap 10. At its end at which it is pivotally connected to the shaft portion 2, the handle 1 is provided in its interior with a recess, indicated at **10*a*, whose configuration provides sufficient clearance from the end cap 10 to permit pivoting of the handle 1**.

The shaft portion 2 has fixed within it, at its end remote from the handle 1, an annular restraint block 11. The restraint block 11 has a shaft restraint tube 12 passing through its centre as a close sliding fit. The end of the shaft restraint tube 12, remote from the handle 1, is closed by a boss 13 with a threaded bore, and at its other end the restraint tube 12 is provided with an external annular collar 14.

The end plate 6 of the tubular shaft portion 5, and the end plate 9 of the further handle 8, are connected to one another by a telescopic restraining assembly comprising a rod 15 and tube **15*a*. The rod 15 has screw-threaded engagement with the boss 13 and also passes through the closure plate 6 at which it is secured by a nut. The tube 15*a* has a threaded boss secured within it at its end opposite the boss 13, and the boss 16 receives a bolt by which it is fixed to the end plate 9 of the handle 8**.

A helical compression spring 17 is disposed within the handle 8 and abuts the shaft restraint block 11 and end plate 9 of the handle 8, to bias these parts away from one another. A further helical compression spring 18 is disposed within the shaft restraint tube 12 and abuts the threaded boss 13 and the end plate 9 of the handle 8, to bias these parts away from one another.

FIG. 5 of the drawings shows the baton in its most compact configuration. The handle 8 is disposed within the shaft portion 2, which is in turn disposed within the shaft portion 5. The springs 17, 18 are compressed. The end cap 10 on the handle 8 occupies the recess **10*a* in the handle 1. A suitable retaining device or catch, not shown, would be provided to hold the tubular shaft portion 5 in its position relative to the shaft portion 2 in which the shaft is of minimum length. For example, a bayonet type fixing may be provided between the shaft portions 2, 5**.

FIG. 6 illustrates the first stage of the extension of the baton. The retaining device or catch such as above referred to is released, so that the shaft portion 5 slides over the shaft portion 8, and at the same time the shaft restraint tube 12 is extended until the collar 14 thereof engages the restraint block 11. At this point, the collar 14 engages a recess in the block 11 so that there is a tight fit to rigidify the extended shaft, whilst further extension of the shaft is prevented. The inside diameter of the shaft portion 5 and the external diameter of the shaft portion 2 may be arranged that there is an interference fit between these two tubular shaft portions over the remaining length by which they telescopically interfit, further to assist rigidity of the shaft of the baton. It will be appreciated that the extension of the shaft of the baton to the condition shown in FIG. 6 is caused by the release of the energy stored in compression spring 18.

Referring now to FIG. 7 of the drawings, the baton may now be converted from a straight baton as illustrated in FIG. 6 to one with a side handle. Any retaining device or catch holding the shaft portion 2 in line with the handle 1 is released, enabling the handle 1 to be pivoted to the position shown in FIG. 7 in which it extends at right angles or substantially at right angles to the shaft portion 2. The end of the handle 8 is then accessible and, as the handle 8 is no longer constrained by engagement with the handle 1, the handle 8 is free to move axially, under the influence of spring 17 and spring 18, out of the shaft portion 2. Thus the handle 8 assumes the position formerly occupied by the handle 1 before the latter was pivotally moved to its transverse position. The axial movement of the handle 8 is arrested by the telescopic length restraining assembly of rod 15 and tube 15*a* which is drawn out to its full extent by movement of the handle 8. Preferably the axial movement of the handle 8 is also constrained by the external diameter of the handle 8 and the internal diameter of the shaft portion 2 being so arranged that there is an interference fit therebetween over the remaining length by which they telescopically interfit, so that the handle 8 is maintained in rigid and semi-permanent alignment with the shaft of the baton.

The baton can be converted back to its original, more compact, condition, e.g. for concealed carrying by a police officer, by axially pushing the handle 8 back into the interior of the shaft portion 2, until the handle 1 is able to be pivoted back to its position in which it is aligned with the shaft. The shaft portion 5 is pressed axially until the position shown in FIG. 5 is attained. The retaining devices or catches of whatever form, provided to maintain the collapsed condition of the baton, can then be engaged.

Instead of the provision of springs 17, 18 within the baton, other means could be provided for causing the baton to be extended, when required, from its compact condition to its extended condition. For example, fluid pressure operated, e.g. gas pressure, means could be provided. Alternatively, extension of the baton could be arranged to take place simply by a user manually pulling the parts of the baton to the extended relative positions, or by appropriately swinging the baton so that the parts extend under centrifugal force.

Figure 9:
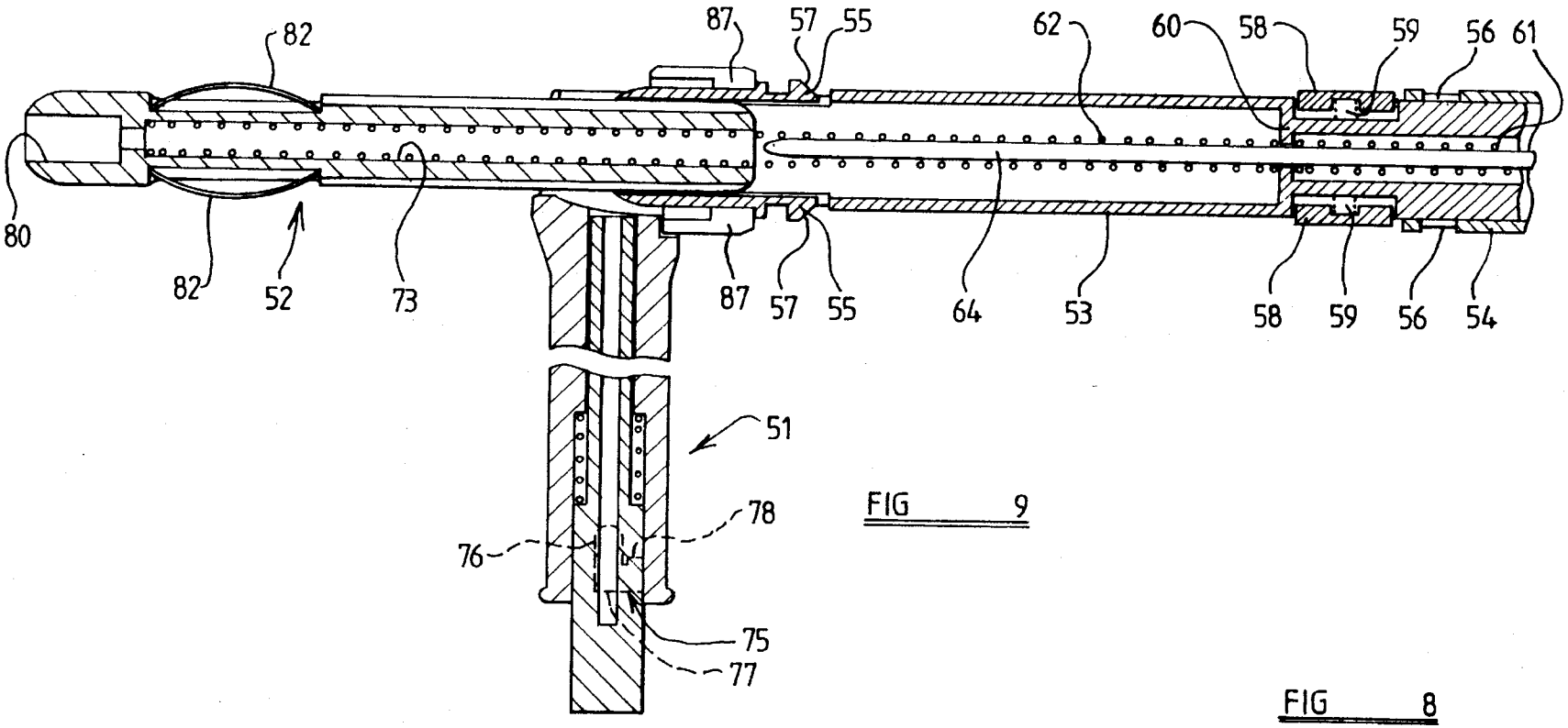
FIG. 9 is the view as FIG. 8 but with the baton in a second condition.
Figure 8:
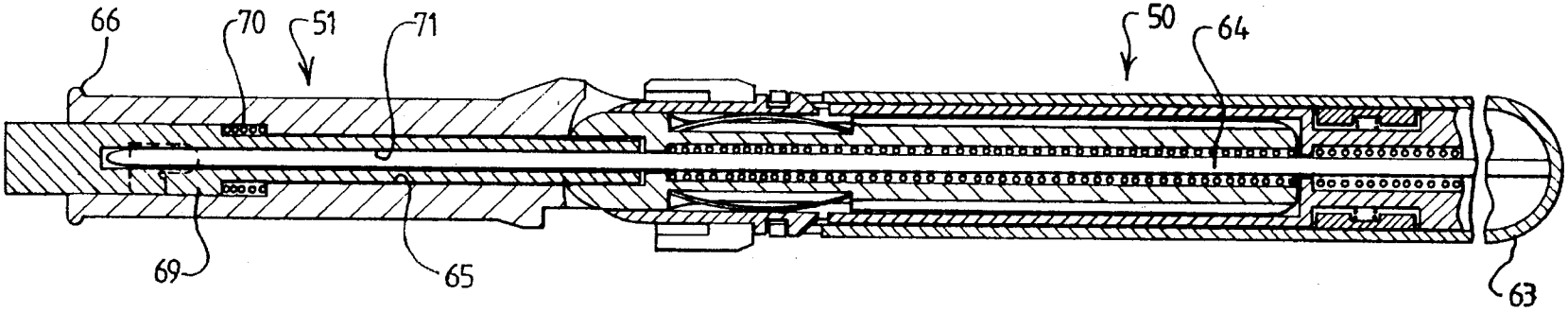
FIG. 8 is a diagrammatic cross-section to a further embodiment of the baton according to the invention in a first condition.
Figure 10:
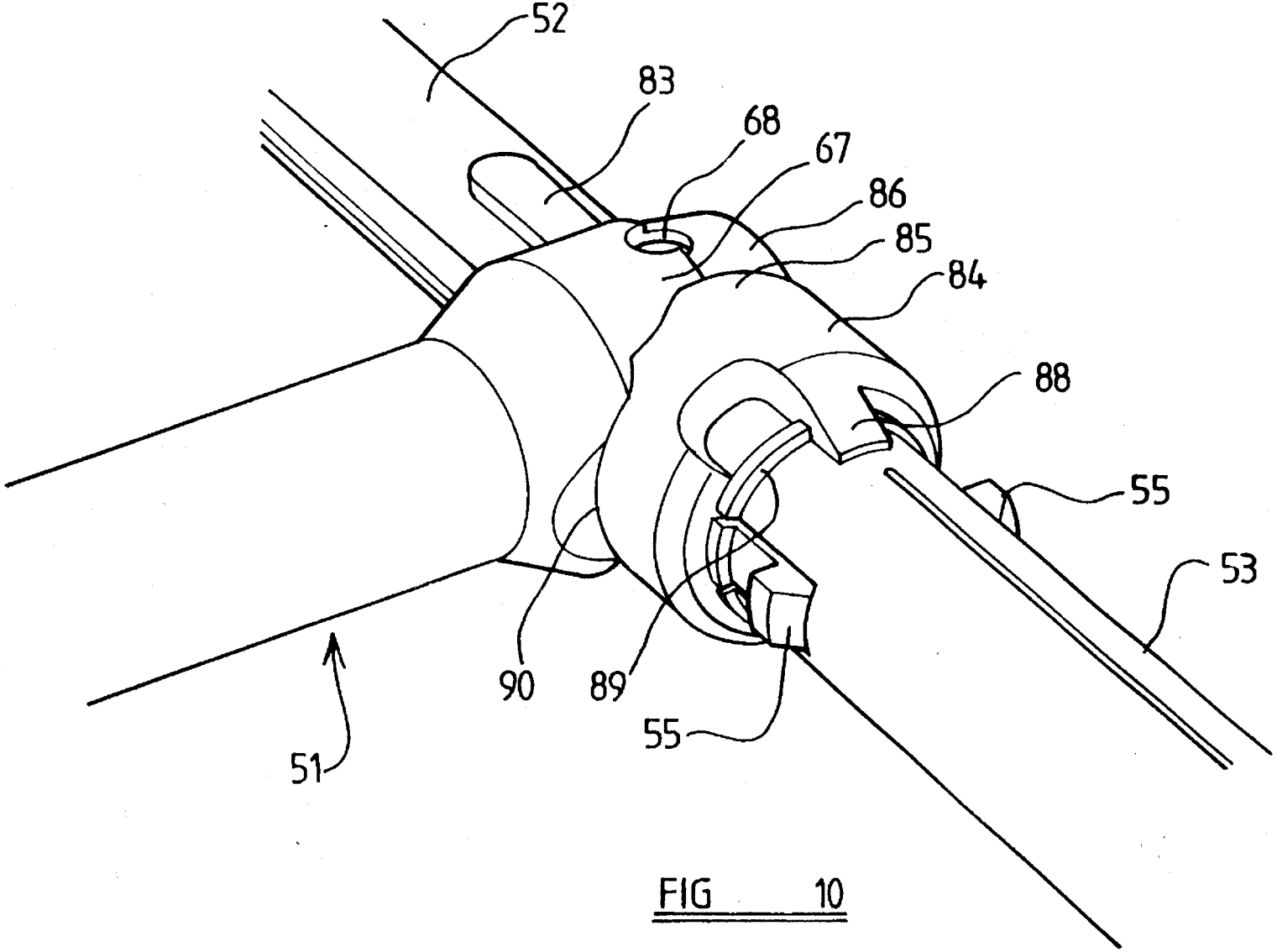
FIG. 10 is a perspective view of part of the baton as shown in FIG. 9.

Referring now to FIGS. 8 to 10 of the drawings, these show a further embodiment of the baton in accordance with the invention. This embodiment comprises a shaft indicated generally at 50, a first handle indicated generally at 51, this handle being pivotable relative to the shaft, and a further handle indicated generally at 52. With the exception of the springs described hereafter the components of the baton may be made of a composite fibre-reinforced plastics material.

The shaft 50 of the baton comprises a first portion 53 and a second portion 54. Both these portions are predominantly tubular in configuration, the internal diameter of the portion 54 being such that it is a close sliding fit on the exterior of the portion 53. Thus the shaft 50 of the baton is telescopically extendable and contractible, being illustrated in FIG. 8 in its contracted condition and in FIG. 9 in its extended condition. The portion 54 has a hemispherical closed end 63.

The portion 53 of the shaft 50 is provided at its one end, at which the first handle 51 is connected as described hereafter, with two catch formations 55 disposed on opposite sides of the portion 53. These catch formations are integral with the portion 53 at their ends furthest from the opposite end of the portion 53, and are engageable as shown in FIG. 8, with correspondingly disposed apertures 56 in the portion 54. The catch formations 55 terminate at their free ends in cam surfaces 57, disposed so that as the portion 54 of the shaft is moved from its extended position as shown in FIG. 9 to its contracted position as shown in FIG. 8, the cam surfaces 57 are engaged by the end of the shaft portion 54 causing the catch formations 55 to be cammed inwardly (i.e. towards one another) whereafter the formations spring outwardly to engage the apertures 56 as shown in FIG. 8 of the drawings.

At the opposite end of the shaft portion 53, there are provided two catch formations 58 which comprise members received in relatively shallow recesses on opposite sides of the shaft portions 53 and spring biased outwardly thereof by springs 59. They are spring biased outwardly to the positions in which they are shown in FIG. 9, wherein they extend sufficiently beyond the circumferential outer surface of the shaft portion 53 to be engageable with the end of the shaft portion 54 and prevent the latter from being moved from its extended position towards its contracted position. When such contraction of the shaft of the baton is required, the members 58 must be manually pressed radially inwardly until they lie flush with the external circumferential surface of the shaft portion 53, enabling the shaft portion 54 to be moved to the position shown in FIG. 8.

Within the shaft portion 53 there is an abutment 60 which is abutted on opposite sides by two coil compression springs 61, 62. The spring 61 engages the closed end 63 of the shaft portion 54, so as to spring bias the shaft portion 54 to its extended position.

The spring 62 engages the further handle 52 as described hereafter. A guide rod 64 is connected to the shaft portion 54 at its closed end.

The handle 51 is generally cylindrical with a stepped internal bore 65. At its one end, the handle 51 has a circumferential lip 66 and at its other end it has an enlarged hollow portion 67 most clearly seen in FIG. 10. The portion 67 is provided with two diametrically opposed apertures, one of which is indicated at 68 in FIG. 10 and these apertures are engaged by respective lugs provided, e.g. formed integrally, on the exterior of the shaft portion 53 adjacent the end thereof, so that the handle 51 is pivoted relative to the shaft portion 53. The range of pivotal movement is substantially 90° between the position in which the handle 51 is shown in FIG. 8 wherein it is in line with the shaft 50 of the baton and the position wherein it is shown in FIG. 9 of the drawings, wherein it is substantially perpendicular to the shaft of the baton.

Within the handle 51, there is disposed an elongate plunger 69 biased outwardly of the handle 51 by a coil compression spring 70. The plunger 69, within the bore 65 of the handle 51, itself has a bore 71 which receives the guide rod 64 when, as shown in FIG. 8, the handle 51 is in line with the shaft of the baton and the shaft portion 54 is in its contracted position.

On its external circumferential surface, adjacent its end where it emerges from the handle 51 is provided with a track 75 which in developed view is L-shaped, comprising an axially extending portion 76 and a circumferentially extending portion 77, the latter terminating in a recess 78. The track 75 is engaged by a peg (not shown) extending inwardly from the interior of the handle 51, and when the peg engages the axially extending portion 76 of the track the spring 70 moves the plunger outwardly of the handle to the position in which the plunger is shown in FIG. 9. When, however, the handle 51 is in line with the shaft of the baton as shown in FIG. 8, the plunger 69 can be moved axially against the spring 70 until the peg engages the circumferentially extending portion 77 of the track. The plunger can then be moved angularly within the handle 51 until the peg enters the recess 78 at the end of the portion 77 of the track to provide a detent to hold the plunger in such position. When this position has been reached, the opposite end of the plunger enters a recess 80 at the facing end of the further handle 52, so that, in addition to the rigidity imparted by the engagement of the guide rod 64 in the bore 71 of the plunger, the rigidity of the handle 51 relative to the shaft of the baton is further increased.

The shaft portion 53 of the baton is able to accommodate the further handle 52, the further handle being predominantly of cylindrical configuration with a bore 73 which is able to receive the guide rod 64 and spring 62. The spring 62 engages the further handle 52, so as to spring bias it out of the shaft of the baton towards the position in which it is illustrated in FIG. 9. When the handle 52 is in the position shown in FIG. 8 in which it is in line with the shaft of the baton, the further handle 51 is not able to move out of the shaft of the baton but instead abuts the handle 51. When the handle 51 has been pivoted to the FIG. 9 position, however, the further handle 52 is able to move out of the shaft of the baton under the influence of spring 62.

The further handle 52 is provided, in diametrically opposed recesses, with respective leaf spring elements 82 which, when the further handle is accommodated in the shaft portion 53, aligned with the catch formations 55 to spring bias the latter outwardly, thereby assisting the security of their engagement with the shaft portion 54 when the latter is to be held in its contracted position. Adjacent its opposite end, the further handle 52 is provided with a diametrically oppositely disposed catch members 83, one of which is visible in FIG. 10, which are similar to the catch members 58. When the further handle 52 is in its position shown in FIG. 9, the catch members 83 must be pressed manually inwardly before the further handle can be moved against the force of the spring 62 to enter the shaft portion 53.

On the exterior of the shaft portion 53, adjacent its end at which the handle 51 is pivotally supported, there is a locking collar 84. The locking collar is movable both angularly about the shaft portion 53 and axially thereon. It includes a rear portion 85 which internally is shaped to co-operate with a tapered portion 86 of the hollow portion 67 of the handle 51 when the handle 51 is aligned with the shaft 53, to hold the handle 51 in this alignment. At its opposite end, the locking collar 84 is provided internally with formation 87 engageable with the catch formations 55 to displace them inwardly and disengage them from the shaft portion 54. The locking collar further has a pair of diametrically oppositely disposed lugs 88, one of which is seen in FIG. 10, which when aligned with correspondingly disposed gaps in a flange 89 on the shaft portion 53 enable the locking collar to be moved axially towards the opposite end of the shaft portion 53 (i.e. to the right with reference to FIGS. 8 and 9). When the locking collar has been thus moved, the rear portion 85 thereof is disengaged from the portion 86 of the handle 51, enabling the handle 51 to pivot from its position in alignment with the shaft of the baton to its position at right angles thereto. The rear edge of the locking collar 84 is cut away at 90 to facilitate such pivoting.

If the baton is initially in the condition shown in FIG. 8 with the shaft contracted and the handle 51 in alignment therewith, rotation of the locking collar about the shaft of the baton releases the shaft portion 54 to extend, under the influence of spring 61. Axial movement of the locking collar when it is aligned as shown in FIG. 10 disengages the locking collar from the handle 51, whereafter release of the plunger 69 as above described enables the handle 51 to be pivoted to its position at right angles to the shaft of the baton. Thereafter the further handle 52 extends under the action of spring 62. Reverse of the above operations enables the baton to assume its original compact condition.

The invention thus provides a baton which is readily convertible between its compact and extended conditions, and which in all operative conditions has its parts firmly held relative to one another so that the baton is rigid in use.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

We claim:

1. A baton comprising:

a shaft having a longitudinal shaft axis;

a first handle having a longitudinal first handle axis;

means mounting the first handle to the shaft and providing for movement of the first handle relative to the shaft between a first position wherein the first handle axis is in line with the shaft axis and a second position wherein the first handle axis extends transversely to the shaft axis;

a further handle having a longitudinal further handle axis;

means telescopically mounting said further handle relative to said shaft with said further handle axis in line with said shaft axis, said means providing for movement of said further handle between an extended position and a retracted position; and said further handle when in its extended position occupying said first position of said first handle.

2. The baton according to claim 1, wherein said shaft comprises at least two shaft portions movable relative to one another in the direction of said shaft axis, whereby the shaft is extendable and contractible.

3. The baton according to claim 2, comprising biasing means operable between said at least two shaft portions of the shaft of the baton, to bias the shaft to an extended condition.

4. The baton according to claim 1, comprising catch means for retaining at least one of said handles of the baton in at least one of the positions able to be assumed thereby.

5. The baton according to claim 1, comprising biasing means for biasing at least one of said handles of the baton to one of the positions capable of being assumed by said at least one of said handles.

6. The baton according to claim 5, wherein said biasing means biases said first handle to said second position.

7. The baton according to claim 5, wherein said biasing means biases said further handle to said extended position.

8. The baton according to claim 5, wherein said biasing means comprises at least one spring.

9. The baton according to claim 1, comprising retaining means for retaining said first handle in said first position, said retaining means being operable between said first and further handles.

10. The baton according to claim 9, wherein said retaining means comprises an element disposed within said first handle and movable in opposite directions along said first handle axis, to be engaged with and disengaged from said further handle.

11. The baton according to claim 1, comprising retaining means operable between said first handle and said shaft for retaining said first handle in said first position.

12. The baton according to claim 11, wherein said retaining means comprises a collar member supported on said shaft and movable in opposite directions lengthwise of said shaft axis, to engage and release said first handle.

13. The baton according to claim 1, comprising flexible strap means for being held by a user.

* * * * *